United States Patent [19]

Minton

[11] 4,094,535

[45] June 13, 1978

[54] CONDUCTIVE HOSE AND ENDS

[75] Inventor: Keith G. Minton, North Canton, Ohio

[73] Assignee: The Hoover Company, North Canton, Ohio

[21] Appl. No.: 758,044

[22] Filed: Jan. 10, 1977

[51] Int. Cl.[2] ..... A47L 9/24

[52] U.S. Cl. ..... 285/7; 339/15; 339/103 R; 285/22; 285/114

[58] Field of Search ..... 339/15, 16 R, 16 C, 339/103 R; 174/47; 285/22, DIG. 16, 7, 114, 119, 423

[56] References Cited

U.S. PATENT DOCUMENTS

| | | | |
|---|---|---|---|
| 3,127,227 | 3/1964 | Edwards | 339/15 |
| 3,224,795 | 12/1965 | Conley | 285/331 X |
| 4,002,358 | 1/1977 | Streit | 285/DIG. 16 |
| 4,012,091 | 3/1977 | Westergren | 285/7 |
| 4,018,493 | 4/1977 | Lyman | 339/15 |

*Primary Examiner*—Andrew V. Kundrat

[57] ABSTRACT

A conductive hose having dual connections disposed in the internal spiral groove formed in an air carrying hose includes plastic molded couplers on its ends which provide the fluidic and electrical connection to members that may be coupled thereto. Each of the molded couplers consists of inner and outer telescoped members that are glued together at their mating peripheries with the inner member including ribbed portions at the junction of the two mating parts. A strain relief is mounted between the members and retained by them so that electrical flow may be securely had through the hose and its couplers.

4 Claims, 4 Drawing Figures

CONDUCTIVE HOSE AND ENDS

BACKGROUND OF THE INVENTION

1. Field of the Invention

This invention generally relates to electrically conductive fluidic hoses and, more particularly, relates to an electrically conductive hose for the powering of a remote vacuum cleaner motorized nozzle.

2. Description of the Prior Art

Although electrical conducting hoses that include coupling members have existed in the art for many years, with most of the more modern couplers having at least a pair of molded, telescoping members utilized to form one of the couplers, these couplers have generally been readily disassembable and thus not absolutely secure as to their electrical connection arrangement, or have been more desirably glued together in an attempt to insure structural fidelity.

Glued configurations raise secural problems, however, since the inner member of the coupling, in order to receive the pneumatic hose and strain relief, is normally of a heavier molded section relative to the outer tubular member, sufficient abutting face-to-face contact is difficult to obtain in molding of it because of the tendency of the relatively thickened inner member to dish (go slightly concave) on its outer face upon cooling. Thus, insufficient, opposed facing area of the confronting surfaces of the coupler members may be the result, with a poor bond that achieved upon gluing.

Additionally, during actual assembly of the two telescoping parts in manufacture, a larger quantity of glue than required may be placed as a coating on the inner member or accommodatable between the two coupling parts even with the natural reservoir afforded by the "dish" of the inner part. Accordingly, glue escapes from the confronting internal face areas of the two telescoping parts and must either be wiped away from the exterior, exposed portions of these parts or left as an unattractive residue lessening customer appeal and salability of the entire assemblage of conductive hose and coupler ends.

It is, therefore, an object of this invention to provide a two-part coupling assembly which may be securely glued to insure structural integrity.

It is a further object of this invention to provide an effective reservoir for the reception and retention of any excess glue that may be squeezed from the abutting jointure between the two coupling parts when they are telescoped together.

It is a still further object of the invention to provide a coupling structure in which the mechanism that insures face-to-face contact between the parts and a reservoir for the excess glue also provides the radial spacing between the coupling parts to permit insertion and retention of the pneumatic hose therebetween.

It is yet another object of the invention to provide a coupling arrangement for pneumatic hose ends which is both secure, attractive and yet provides efficient fastening means on its ends for outward confluent connection and electrical attachment.

BRIEF DESCRIPTION OF THE INVENTION

In a preferred embodiment of the invention, a pneumatic cleaner hose having an internal wire reinforcement is provided with couplers on its distal ends. The wire reinforcement acts as a conductor for the passage of electric current and is connected to the coupler ends to permit ease in connection of electrical supply and electrical demand plugs outwardly of the hose coupler ends.

In furtherance of this aim, the hose conductors, at one end, are connected to a female plug mounted, essentially, rigid or fixed to its respective coupler. At the other end the hose conductors are attached to a male plug that is disposed at the end of a short cord lead extending from one of the coupler ends.

A strain relief is interposed into the conducting path at this coupler end by being mounted fixed relative to the parts making up the coupler.

The couplers, at each end, generally comprise two-part inner and outer telescoping members which are joined at abutting faces by the use of a glue or other adhesive substance so as to provide a pair of hose coupler ends not easily disassembled. To this end, each of the outer members of the coupler includes adjacent its outer end, a generally continuous tubular section providing a uniform bore. The inner coupler parts, confronting these bores, are of generally cylindrical ribbed shape, the outer radial dimensioning of the ribbing providing light abutting contact with the bores of the outer coupler parts. The ribs are axially separated by radially inwardly disposed lands so that the equivalent of grooves are formed between the ribs.

Because of the lessened, molded cross section afforded by such rib structure, the inner coupler part, in the area of the ribs, is of generally uniform radial cross section in contrast to a solid molded part providing a dished outer periphery. This insures that all the ribs furnish an active, positive area for the application of glue or adhesive which will adhere to the corresponding inner peripheral areas on the outer tubular member. At the same time, excess glue, which is applied to this inner piece may be scruffed off the periphery of the ribs, upon telescoping insertion of the inner coupling part to lodge in the grooves between the ribs so that none of the adhesive is squeezed out between the coupler parts to be deposited on the exterior surface of the couplers.

The ribs also are of sufficient radial extent and the inner coupler part of such lessened radial extent behind the ribs that the volume between the two coupler parts, at their inner end, permits lodging of the conductive hose therebetween. A series of spherical ribs on the inner part, at these inner locations, permits the conductive hose to be screwed on the inner part so as to be lockingly maintained in the volume described.

Each of the inner coupling parts, in the rib area includes, essentially, a cutout for the locking lodgement of a strain relief or a female plug. This cutout is formed in the bottom side of the inner coupler part, on each end, and includes locking tabs in opposed relation which extend into locking grooves of the female plug and strain relief to maintain them axially, while the outer coupler part prevents radial displacement of these two elements.

To provide additional securement between the two coupler parts on each end of the conductive hose, a rivet or similar element extending through the sidewalls of the respective inner and outer coupler part walls may be utilized.

The general assemblage of each coupler is completed by the provision of a connecting structure for outward connection of the conducting hose. In the coupler and having the strain relief, this connecting structure takes the form of an integral extension on the inner coupler part which includes three radially extending tabs disposed on the outer circumference of the extension. These tabs, as is obviously conventional, may provide for a bayonet type connection to a canister cleaner or the like, with the extension angled at its termination to insure easy connection to such a canister cleaner.

The opposite coupler includes, as an integral extension of the inner part, a peripherally, annularly grooved tubular section. Mounted in this peripherally grooved area is a connecting ring capable of partial circumferential manipulation within the peripheral groove. A locking groove within the tubular section occasions capture of a properly configured wand end or the like connect this remote end of the conductive hose to a powered nozzle (not shown) or the like.

Reference may now be had to the accompanying drawings for a better understanding of the invention, both as to its organization and function, with the illustration being of a preferred embodiment, but being only exemplary, and in which.

DETAILED DESCRIPTION OF THE INVENTION

Figure 1:
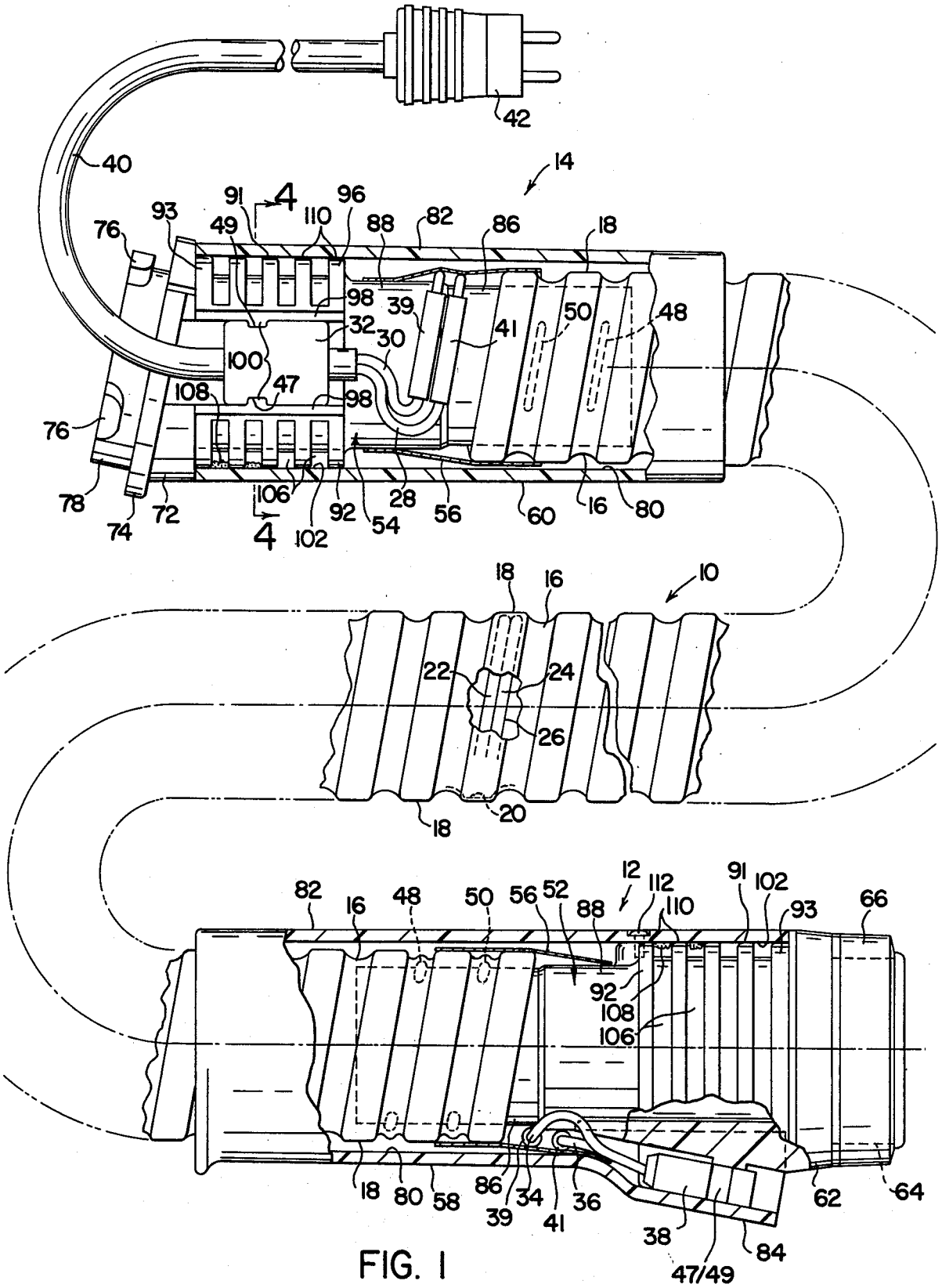
FIG. 1 is a longitudinal elevational view of the conductive hose and coupler ends of the invention, with certain parts broken away for clarity.
Figure 2:
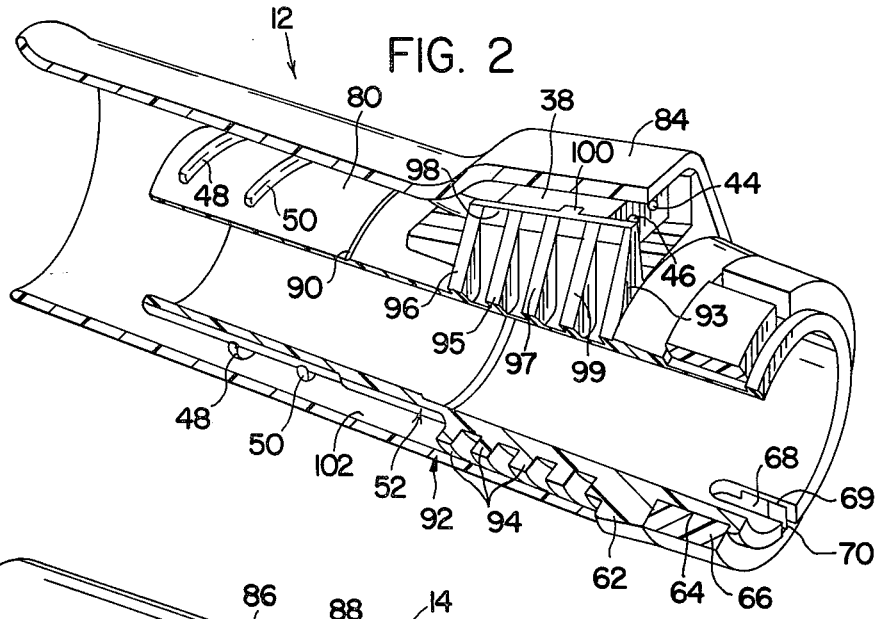
FIG. 2 is a perspective view, partially in irregular cross section, of the coupler end in which nests the female plug.
Figure 3:
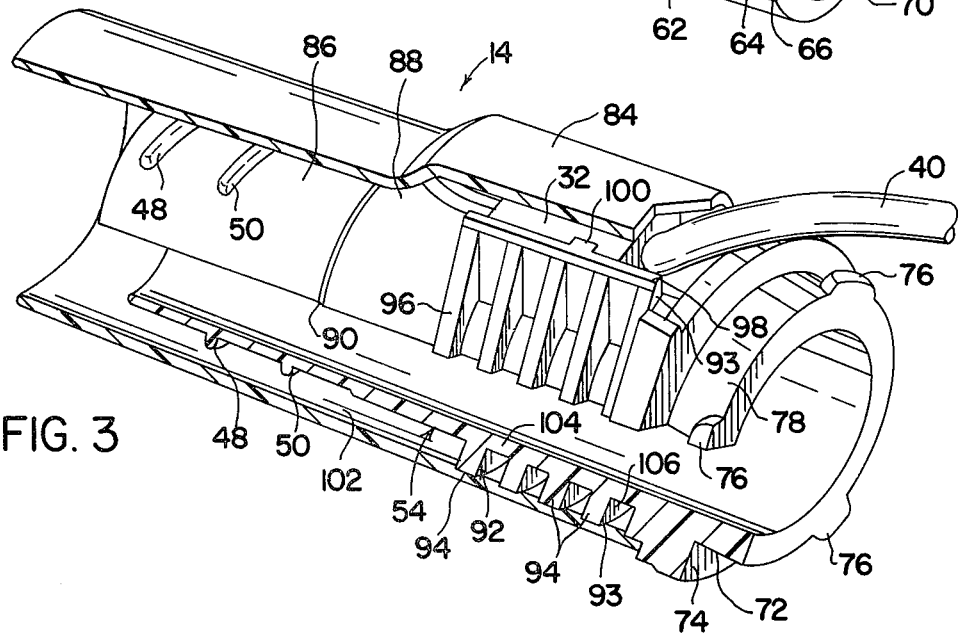
FIG. 3 is a perspective view, partially in irregular cross section, of the coupler end having the male plug.
Figure 4:
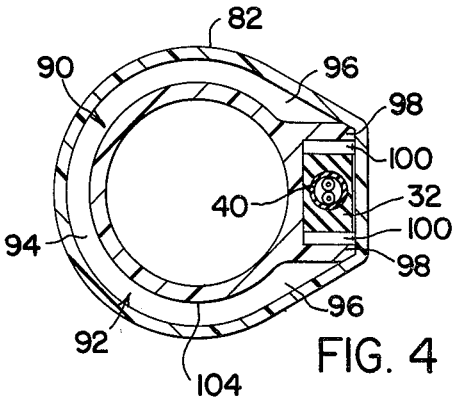
FIG. 4 is a view in cross section of the invention taken on line 4—4 of FIG. 1.

With particular attention directed to FIG. 1, it can be seen that an electrically conductive hose 10 having couplers 12 and 14 is provided in furtherance of the inventive concept. The conductive hose 10 may take many forms but it is preferred that a hose having a corrugation formed by a continuous spiral groove 16, separated by a radially outwardly extending continuous spiral rib 18 be utilized.

As is seen in one of the cut away portions of FIG. 1, the spiral rib 18 provides an internal peripheral groove 20 in which is lodged a pair of insulated conductors 22, 24, these conductors normally being bonded to the wall of the hose 10 and forming a support structure for it. The conductors 22, 24 are generally formed as an integral cord structure 26, similar to a lamp cord, so that a standard, easily obtainable conductor insulated configuration may be utilized in the conducting hose 10.

At each end of the conductor hose 10, the conductors 22, 24 terminate in pigtails which are spliced to leads 28, 30 extending from a strain relief 32 and leads 34, 36 extending from a female plug 38. A pair of small elastomeric, tubular sleeves 39, 41 may be utilized to cover the spliced connection between the pigtails formed by the termination of hose conductors 22, 24 and the leads 28, 30, or the leads 34, 36. Alternately, splices having their own integral insulating sleeves may be used. A rib (not shown) may be utilized to separate the tubular sleeves 39, 41, the said rib being integral with an inner coupling member.

Each of the leads 28 and 30 and each of the leads 34 and 36 extend inwardly of the strain relief 32 and female plug 38, respectively, to be held therein, conventionally, by molding of the plug and strain relief. These elements are conventional and commercially obtainable, with the strain relief 32 including a cord 40 and molded-on plug 42 and with the female plug including prong-receiving receptacles 44, 46. In view of the commercial availability or substantial conventiality of strain relief 32 and female plug 38 no further discussion of them will be had save to indicate that each includes a pair of vertically extending grooves 47, 49, disposed on opposite sides of the strain relief 32 or female plug 38 and aligned with each other. The purpose of these grooves will appear more clearly at a later point in the description.

The electrically conductive hose 10 is mounted between the couplers 12, 14 by the use of integral, spirally oriented ribs 48, 50, e.g., extending radially outward from one of the inner members 52, 54 of the couplers 12, 14. The conductive hose is mounted by a screwing, telescoping movement utilizing the ribs 48, 50 as screw threads guiding the conductive hose 10 onto the inner members 52, 54.

The electrically conductive hose 10 may further be conventionally retained to the coupler inner members by a cement or glue (not shown) which is applied to the inner periphery of the hose ends prior to their screwing assembly over the inner coupler members.

A layer of tape 56 may then be wound around each of the inner members 52, 54 enveloping the hose ends and each of the inner members in the area of the ribs 48, 50, and also enveloping the splices between the hose electrical conductors 22, 24 and the leads extending from the strain relief 32 or female plug 38, thus covering the elastomeric, tubular sleeves 39 and 41 and unitizing, to a degree, the hose ends, required wire splices and inner members 52, 54 of the couplers 12 and 14.

Outwardly of the telescoping jointure of the inner members 52, 54 of the couplers 12, 14 and a pair of respective outer members 58, 60, the inner members 52, 54 differ. Inner member 52, at this location, includes an integral tubular extension 62 having an annular groove 64 in which is mounted a split ring 66. An L-shaped groove 68, including a lead in axially extending portion 69 in tubular extension 62 may be aligned with an axially extending groove 70 in split ring 66 to permit insertion of a pin carrying member (not shown) which is to be coupled to the conducting hose 10 at this end. As is conventional in this type of connection arrangement, after simultaneous pin insertion (not shown) into aligned groove 70 and axially extending portion 69 of L-shaped groove 68, the split ring 66 is rotated placing the pin into the other, nonaxially extending portion of the L-shaped groove to lockingly couple the pin-carrying member (not shown) to the coupler 12.

The coupler 14 outwardly of the telescopic jointure of its inner and outer members 52, 58, respectively, includes a tubular extension 72 having an angulated peripheral flange 74 and a series of three radially extending, equally spaced, lugs 76, 76, 76 mounted integral with an angularly disposed integral end portion 78. Such an arrangement is generally conventional but because of the recited angular disposition of some of the described parts, lends itself to an upwardly angled disposition of the conductor hose 10 relative to, for example, a canister cleaner (not shown).

Inwardly of the tubular extensions 62, 72, couplers 12, 14 are substantially similar. More specifically, outer coupling members 58, 60 are generally tubular in configuration, each having an inner tubular, cylindrical section 80, within which one end of conductor hose 10 is mounted and an outer shell section 82, also generally tubular and cylindrical, but including an angled pocket 84 within which is captured the strain relief or female plug. This outer shell section also covers a correspondingly shaped arrangement (to be described) on each of the inner members 52, 54 of the couplers 12, 14.

Inner members 52, 54 of couplings 12, 14, respectively, are also substantially similar. As was set out previously, they include spiral ribs 48, 50, with these ribs mounted integrally on innermost tubular, cylindrical section 86 of slightly smaller outer diameter than a secondary tubular, cylindrical section 88 to which it is joined integrally. A shoulder 90 formed between these two sections limits the telescoping action of conductor hose 10 over the inner members 52, 54 by acting as a stop therefor.

Outwardly disposed, relative to secondary tubular, cylindrical section 88 is a generally ribbed section 91, with the individual ribs 92, 95, 97, 99 of this section being of generally circular disc shape for substantially two thirds of the outer peripheral extent of their inner member, and being angulated from the opposite end terminations of the disc shape so as to fit within the angled pocket 84. Each rib 92, then, is comprised of a disc portion 94 and two angled portions 96, 96 which smoothly merge into the disc portion 94. Each of the other ribs 95, 97, 99 is similarly shaped. The opposite angled portions 96 of the rib 92 are terminated at their other ends by an integral axially extending wall 98, with the formed parallel walls 98 also integral with the ribs 95, 97, 99 and receiving therebetween the strain relief 32 or female plug 38. A generally inwardly extending integral tab 100 on each wall is provided in opposed confronting relationship to axially capture the strain relief 32 or female plug 38 by being received in the grooves 47, 49 provided in these parts. The ribbed section 90 terminates in a forward flange 93 of generally the same shape as the ribs 92.

The ribs 92, 95, 97 and 99 are dimensioned so that a slight abutting contact is had between each of them and a generally uniform internal periphery 102 on the concerned outer shell section 82 of either of outer coupling members 58, 60. More specifically, because of the generally thin wall section and, thus, relatively small mass of the outer members, normal plastic molding provides fairly close and uniform tolerances for the internal dimensioning of the outer shell section 82 and included angled pocket 84, thus providing a generally uniform diameter in its cylindrical portions and generally uniform dimensioning in its angled pocket 84.

At the same time, since the inner members 52, 54 are not molded with a continuous surface, in the area of adhesive confrontation with the outer members 58, 60, in an attempt to mate these areas throughout their extent, a relatively fixed and predictable outer dimensioning of the ribs of inner members is obtained. Their diameters, in their circular section, are fairly uniform, while the dimensioning obtainable by molding of the periphery of the ribs 92, 95, 97 and 99, which fit within the angled pocket 84, are also generally uniform so as to provide a fairly close fit between the inner and outer members for ease in gluing them together.

The ribs 92 are also each designed so as to have a generally uniform cross section, with this cross section fairly closely approximating the cross section of an underlying cylindrical section 104 from which the ribs 92 jut. This aids in obtaining a close peripheral dimensioning in the critical glued area of the inner members 52, 54 of the couplers 12, 14, respectively. This uniform design dimensioning and, primarily, the aforesaid use of a ribbed structure contrasts strongly to an inner member wherein the area comprising the ribs is molded as a solid section. Unavoidably, dishing of such a section occurs, with a poor gluing surface than provided for adhesive attachment of the inner and outer members of the concerned coupling.

Between each of the ribs 92, a groove 106 is formed which spaces the ribs one from the other, limits the total mass of the molded section and provides a lodgment or reservoir volume for excess glue 108 which results from application of too heavy a coat of glue to the inner member 52, 54 during the manufacturing process.

Assembly of one of the couplers 12, 14 to the conducting hose 10 is exactly the same and is easily described. The outer coupling member 60, for example, is telescoped over one end of the conducting hose 10 and moved inwardly away from this end. The inner coupler member 54 is inserted in the hose end after the hose end has been coated with glue or cement, if desired, by screwing the conductor hose over the spiral ribs 48, 50. The requisite splice between the hose conductors 22, 24 and the leads 28, 30 accomplished, the same being protected by the tubular sleeves 39, 41. The strain relief is mounted between the walls 98, 98 and engaged by the tabs 100, 100. Tape 56 is wrapped over the hose end, spliced connections and the inner portion of inner coupling member 54. Glue or adhesive is then applied to the periphery of the ribs 92, taking care to not coat front flange 93, and the outer coupling member 60 telescoped over the inner coupling member. This telescoping action forces excess glue into the grooves 106, resulting in an adhesive layer 110 disposed between the rib ends and the internal periphery of the outer member to uniformly bond the two together and insure a unified, generally non-disassembable structure, the radial spacing afforded by the ribs 92, 95, 97 and 99 permitting nesting of the hose 10 within its concerned connector. The assembly is completed by the riveting of the inner and outer coupler members by a rivet 112 or the like.

It should be clear from the invention described that the same satisfies all the objects set out for it at the beginning of the description. It should also be clear that many modifications could be made to it which would fall within the spirit and purview of the description offered. For example, ultrasonic welding could be utilized as the bonding agent, then the rib and groove structure would provide thinned sections for the ultrasonic welding process.

What is claimed is:

1. An electrically conductive hose including at least one plastic coupling assembly, the combination including;

(a) an inner plastic coupling member having a means for attachment of a hose. '(b) a hose in telescopic relationship with said inner, plastic coupling member, (c) an outer plastic coupling member received over said inner coupling member and including an internal periphery, (d) means forming annular ridges on said inner coupling member, said ridges being spaced from each other by reliefs disposed between said ridges, said ridges having at least portions with substantially equal radial extent, (e) terminations on said portions of said ridges being in generally tight abutting contact with portions of said internal periphery of said outer member, said portions having a generally constant annular extent, (f) adhesive means disposed between said terminations, (g) said means forming annular ridges formed on an enlarged portion on said inner coupling member of sufficient size to mount a strain relief.

2. An electrically conductive hose including at least one plastic coupling assembly, the combination including;

(a) an inner plastic coupling member having a means for attachment of a hose, (b) a hose in telescopic relationship with said inner, plastic coupling member, (c) an outer plastic coupling member received over said inner coupling member and including an internal periphery, (d) means forming annular ridges on said inner coupling member, said ridges being spaced from each other by reliefs disposed between said ridges, said ridges having at least portions with substantially equal radial extent, (e) terminations on said portions of said ridges being in generally tight abutting contact with portions of said internal periphery of said outer member, said portions having a generally constant annular extent, (f) adhesive means disposed between said terminations, (g) said ridges extending radially outwardly from a main body of said inner plastic coupling to thereby space said outer plastic coupling therefrom, (h) said hose passing into said plastic coupling assembly into said space and being received nestingly therein, (i) fastening means that includes a projecting shank extending through said first and second coupling members to maintain them rigidly together as a unitized assembly, and (j) said reliefs being capable of serving as wells for excess adhesive means squeezed out from between said termination on said internal coupling member and said portions of said internal periphery of said outer coupling member.

3. An electrically conductive hose including at least one plastic coupling assembly, the combination including;

(a) an inner plastic coupling member having a means for attachment of a hose, (b) a hose in telescopic relationship with said inner, plastic coupling member, (c) an outer plastic coupling member received over said inner coupling member and including an internal periphery, (d) means forming annular ridges on said inner coupling member, said ridges being spaced from each other by reliefs disposed between said ridges, said ridges having at least portions with substantially equal radial extent, (e) terminations on said portions of said ridges being in generally tight abutting contact with portions of said internal periphery of said outer member, said portions having a generally constant annular extent, (f) adhesive means disposed between said terminations, (g) said ridges extending radially outwardly from a main body of said inner plastic coupling to thereby space said outer plastic coupling therefrom, (h) said hose passing into said plastic coupling assembly into said space and being received nestingly therein, (i) a strain relief being disposed between said inner and outer coupling members, (j) said strain relief disposed in a walled well formed on an enlarged portion of said inner, plastic coupling member, and (k) said ridges at least partly formed on the exterior of said well wall to thereby provide an enlarged gluing surface for said adhesive to maintain the inner and outer plastic coupling members in assembled relationship.

4. The electrically conductive hose of claim 3 wherein, (a) said ridges are angulated adjacent the strain relief inwardly and upwardly, and (b) said outer plastic coupling member outwardly conforms with and is closely received over the angulated ridge portions to be angled inwardly and upwardly and to thereby form a rigidified structure therebetween.

* * * * *